United States Patent [19]

Lindeman et al.

[11] Patent Number: 4,639,056

[45] Date of Patent: Jan. 27, 1987

[54] CONNECTOR CONSTRUCTION FOR A PC BOARD OR THE LIKE

[75] Inventors: Richard J. Lindeman, Wood Dale; Thaddeus M. Rachwalski, Wheaton, both of Ill.

[73] Assignee: TRW Inc., Redondo Beach, Calif.

[21] Appl. No.: 740,093

[22] Filed: May 31, 1985

[51] Int. Cl.[4] ..... H01R 9/09; H01R 13/405

[52] U.S. Cl. ..... 339/17 LC; 29/841; 339/176 MP; 339/218 M

[58] Field of Search ..... 339/17 L, 17 LC, 17 LM, 339/176 MP, 210 R, 210 A, 218 R, 218 C, 218 M; 29/832, 840, 841, 855, 876, 878

[56] References Cited

U.S. PATENT DOCUMENTS 3,289,147 11/1966 Takeuchi et al. ..... 339/176 MP
3,585,563 6/1971 Hegle ..... 339/218 C
3,673,548 6/1972 Mattingly, Jr. et al. ..... 339/17 L
3,818,280 6/1974 Smith et al. ..... 339/176 MP
3,991,346 11/1976 Reid et al. ..... 339/17 LC
4,205,365 5/1980 Kalina ..... 29/855

*Primary Examiner*—Neil Abrams
*Attorney, Agent, or Firm*—Joseph P. Calabrese; Sol L. Goldstein

[57] ABSTRACT

A connector for use in a standard electronic module assembly comprises an insulator housing a plurality of contacts arranged in close packed relation. The contacts project from one insulator surface for engaging a mating connector or connectors. Continuations of the contacts are arranged for alignment along opposed lateral edges of an opposed insulator surface and are inwardly bent for engagement of circuitry of a centrally located PC board. The board is mounted on a mounting place secured in place between the opposed contacts to provide resistance to insulator bending.

13 Claims, 17 Drawing Figures

FIG. 1
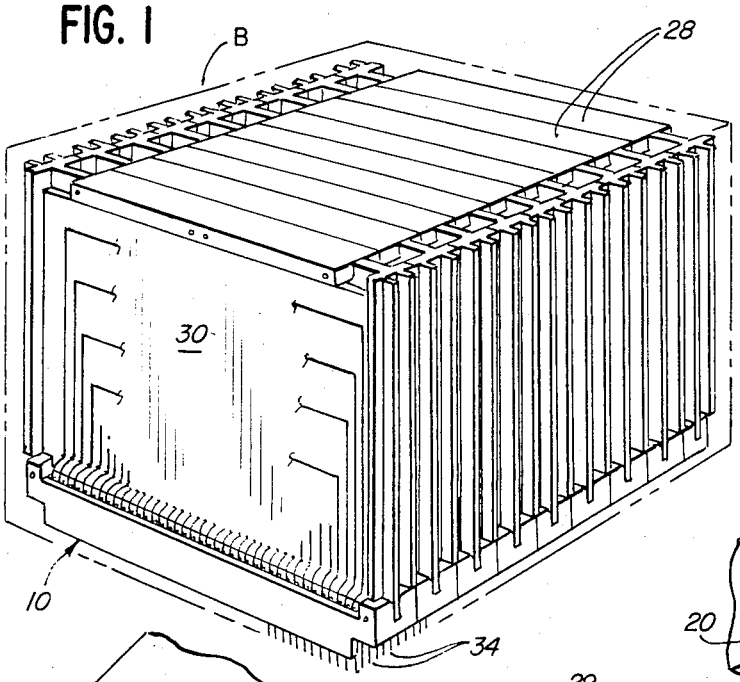
FIG. 2
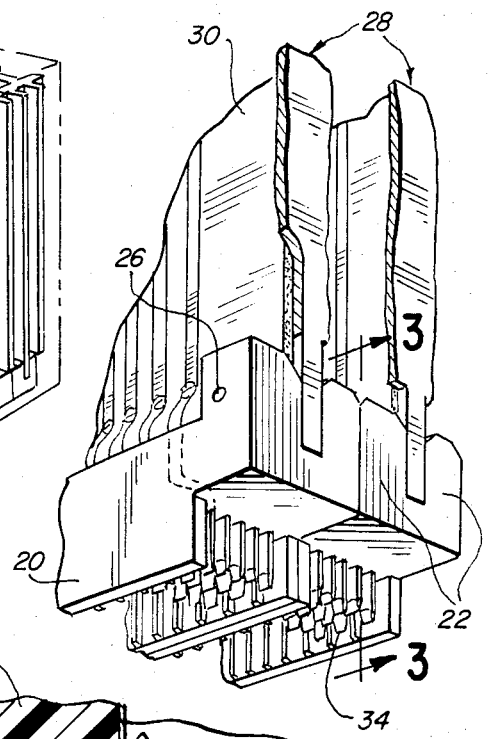
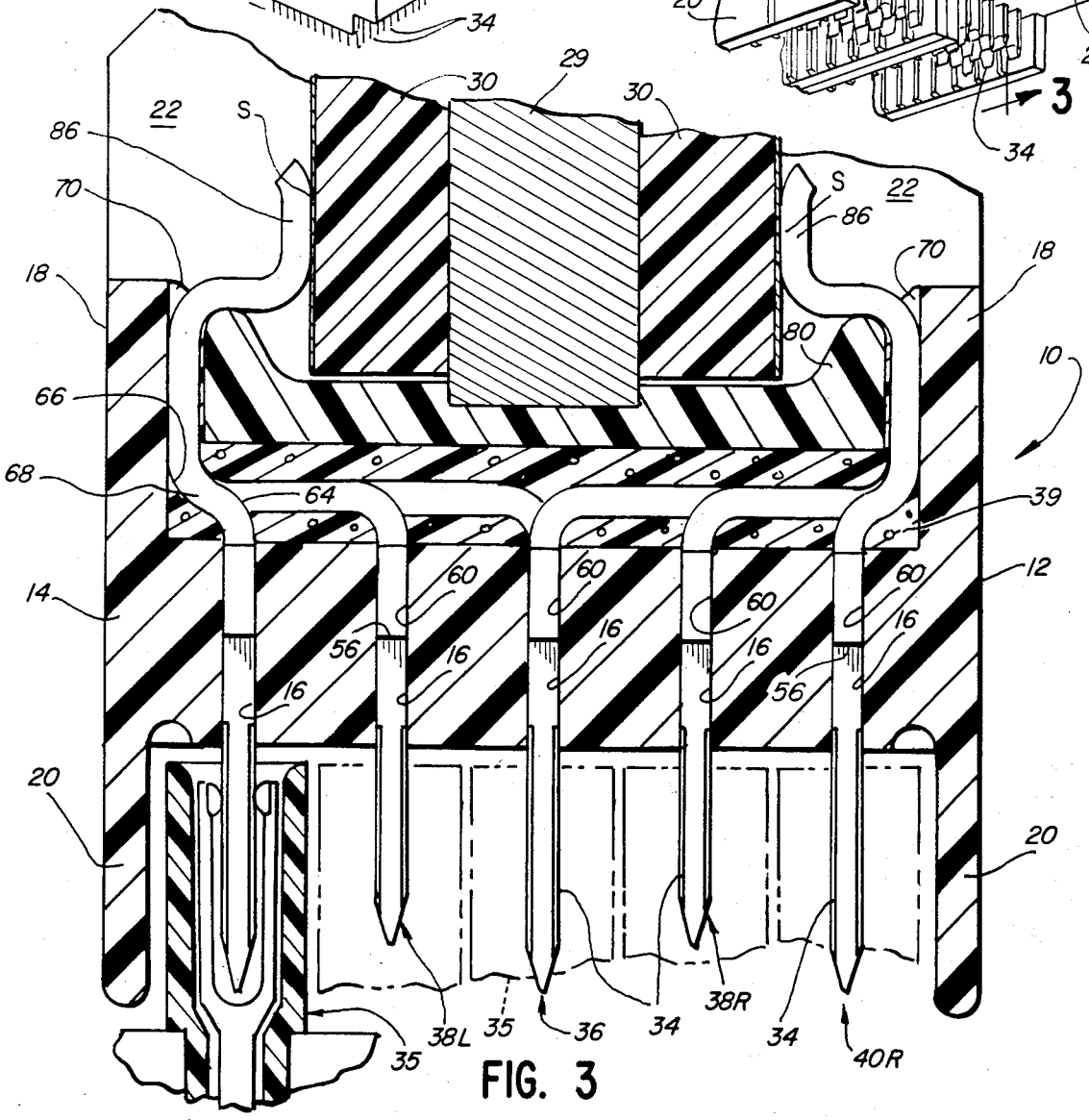
FIG. 3

FIG. 10
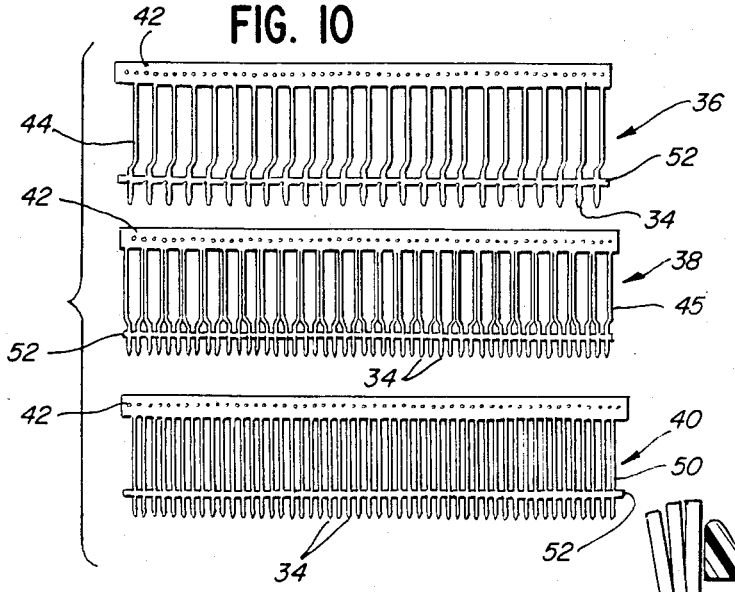
FIG. 11
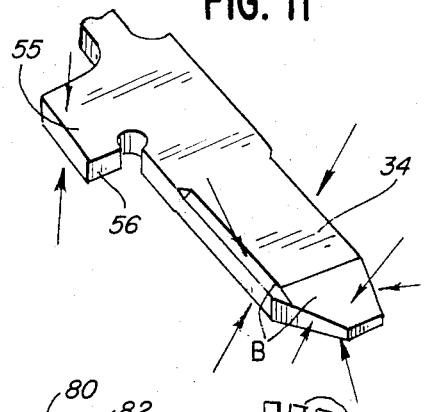
FIG. 12
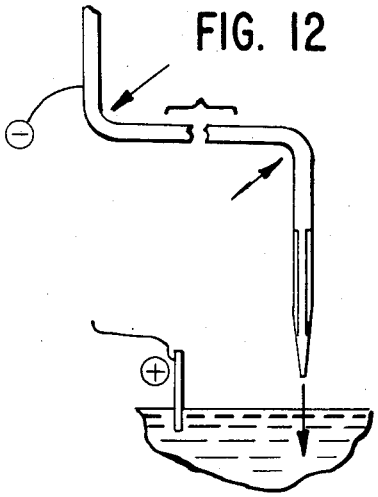
FIG. 13
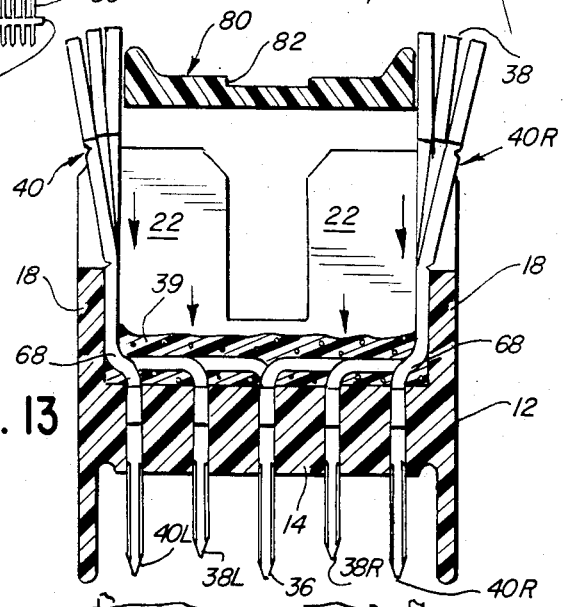
FIG. 14
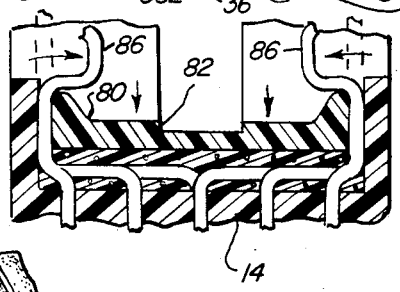
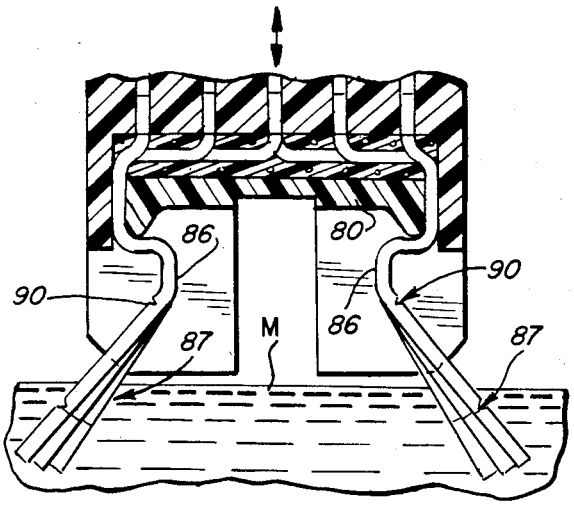
FIG 15
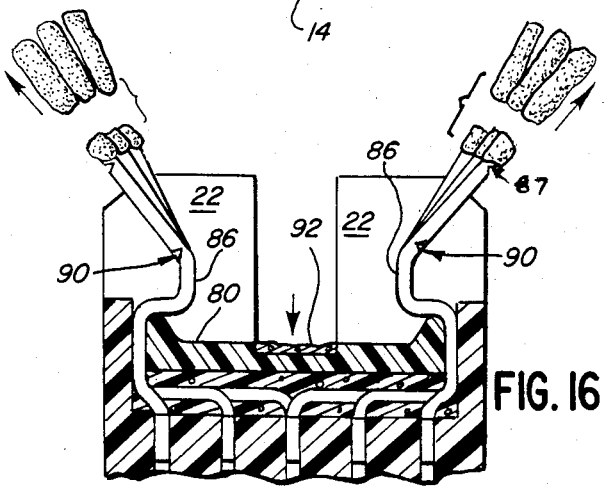
FIG. 16

CONNECTOR CONSTRUCTION FOR A PC BOARD OR THE LIKE

This invention pertains to a connector construction, and more particularly relates to an SEM connector or standard electronic module connector. The concept of the standard electronic module has been used in the past primarily in military applications, although use has progressively increased in a large number of nonmilitary applications.

The provided connector is one element in the SEM module which typically comprises a connector, a boardmounting frame attached to the connector and a PC board such as a ceramic substrate mounted on the frame. the latter may carry circuitry including simple to very sophisticated integrated circuits. Each SEM is adapted to carry out a specific function and has been used by the military in aircraft computer "black boxes" each of which contains a plurality of such modules. The connectors and modules employ a close-packed arrangement of contacts which occupy a minimum of space. The latter is obviously desirable in military and commercial avionics and is similarly desirable in other military applications as in submarines, tanks, etc., where space is also at a premium. As commercial office space becomes increasingly expensive, SEM connectors are coming into increasing use in computer and other applications where compactness for space-saving purposes is desired.

Removable SEMs are an important time-saving mechanism as when a single component fails. In military applications rather than replacing the entire "black box", a single module containing the defective element may be replaced. The modules, by means of projecting contact portions, may be readily disconnected from and connected to a mating connector. The SEM system is now under consideration for multi-service usage in U.S. military avionics. Thus the principle of exchanging standard modules instead of complete "boxes" will decrease aircraft downtime and allow interchangeability of modules in different aircraft and branches of service.

The prior art connector for standard electronic modules essentially comprises that manufactured by Teradyne Components of Nashua, N.H. Such connector is expensive to manufacture, comprising an aluminum housing employing blade contacts mounted in insulating nylon bushings. The connector is further comprised of a copper flex circuit sandwiched between two plastic layers and soldered to the individual blade contacts. The flex circuit has terminal contact portions for engaging the circuitry of printed circuit boards mounted in a frame supported on the aluminum housing by means of a second series of soldered connections. The connector, frame and printed circuit boards thus comprise an electronic module.

Such prior art connector assembly with the printed circuit boards is subject to certain operating difficulties. Such difficulties are due in part to the use of the flex circuit requiring two series of soldered connections. When placed in an environment in which the connector is subjected to vibration, the soldered connections are susceptible to breakage, leading to circuit failure. Also, as the connector houses contacts in close-packed arrangement, 250 contacts being typical, the insertion force necessary to mate the contact terminals in a mating connector or connectors effects bending of the connector body housing the contacts, again resulting in lead damage and circuit failure.

In accordance with the provided invention of this application, a connector for use in a standard electronic module is provided employing a synthetic plastic insulator of H-beam design. The connector employs a modular insulator housing of high desired strength having integral contacts which eliminate one set of soldered connections necessary in prior art connectors. The connector housing is formed of a glass-filled thermoplastic which has a substantially identical coefficient of expansion with that of the printed circuit boards mounted on said connector so as to obviate any soldered connection strains resulting from different rates of board-insulator expansion at elevated temperatures.

The provided connector also employs a framemounting plate which rigidifies the connector against bending along its length in the course of engaging or disengaging a mating connector.

It is an object of this invention therefore, to provide a novel connector construction and method of making the same. Such connector is intended for use in a standard electronic module which employs soldered contact connections with PC boards which are highly resistant to breakage.

It is another object of this invention to provide a connector for use with printed circuit boards which is longitudinally reinforced by a mounting plate integrally joined with the connector insulator.

It is yet another object of this invention to provide a module construction in which elements thereof, although formed of different materials of fabrication, have substantially identical coefficients of expansion so as to obviate contact breakage when such modules are subjected to elevated temperatures in the course of module use.

It is a further object of this invention to provide a connector construction of high strength which is readily formed from materials of composition of low cost and yet possesses a durability and efficiency of operation not present in module connectors of the prior art.

It is yet another object of this invention to provide a connector construction employing contacts having solder-tails of uniform cross-section adapted to provide equal maximum current-carrying capacity to the various electronic elements of the module.

The above and other objects of this invention will become more apparent upon proceeding with the following description when read in the light of accompanying drawing and appended claims.

In one embodiment of the provided invention an insulator body of H-beam design is provided which is formed from a glass-filled thermoplastic material having excellent electrical insulating properties. A plurality of contacts are mounted in the insulator base portion. The contacts are precisely positioned in close-packed arrangement in locating insulator apertures so that contact blade portions adapted to mate with a mating connector or connectors extend from one insulator surface in transversely and longitudinally aligned rows. Contact solder-tail portions extend from an opposed insulator surface and are bent over such surface so as to form contact portions aligned adjacent the inner surfaces of opposed longitudinal insulator sidewalls. The contacts are then fitted in place in receiving slots formed in the walls. A mounting plate for mounting a printed circuit board is precisely located and secured in place along the length of the connector upper surface. The opposed contact rows are then bent so as to be in position to engage solder pads on the ciruit boards to be centrally mounted on the secured mounting plate.

The connector user mounts a frame and secured printed circuit boards on the support plate and secures such frame and boards in place on the plate. The user then solders the contacts to the board pads by IR or vapor phase or similar soldering techniques, and the resulting module is ready for use by mating connector contacts with the contacts of another connector or connectors.

For a more complete understanding of this invention reference will now be made to the drawing wherein:

FIG. 1 is a perspective view illustrating an assemblage of standard electronic modules incorporating connectors of this invention assembled in a box indicated in phantom line;

FIG. 2 is a fragmentary perspective view of two modules of FIG. 1;

FIG. 3 is a transverse sectional view taken along line 3—3 of FIG. 2;

FIG. 10 is an elevational view of the initial form of the contact combs or blanks employed in making a connector of this invention;

FIG. 11 is a fragmentary perspective view illustrated on a greatly enlarged scale of a contact blade portion formed from the combs illustrated in FIG. 10 following shearing and coining operations.

FIG. 12 is a schematic representation of a contact plating step carried out prior to insertion of such contacts into an insulator housing;

FIG. 13 is a transverse sectional view of a connector of this invention in the process of having a mounting plate element inserted into place;

FIG. 14 is a view similar to FIG. 13 illustrating a connector of this invention after a PC board mounting plate has been secured in place in an insualtor housing, and opposed rows of contacts bent into desired position;

FIG. 15 illustrates a dipping step wherein contacts of a connector of this invention have an insulating contact-stabilizing substance applied to the contact ends for purposes of maintaining the same in desired relative relationahip prior to being soldered in place on a PC board, and so that the connector can be electrically tested, and;

FIG. 16 is a view similar to FIG. 15 and illustrates a connector of this invention in condition for receiving PC boards and a frame prior to forming a final module assembly.

DESCRIPTION OF THE INVENTION

Figures 4, 4A:
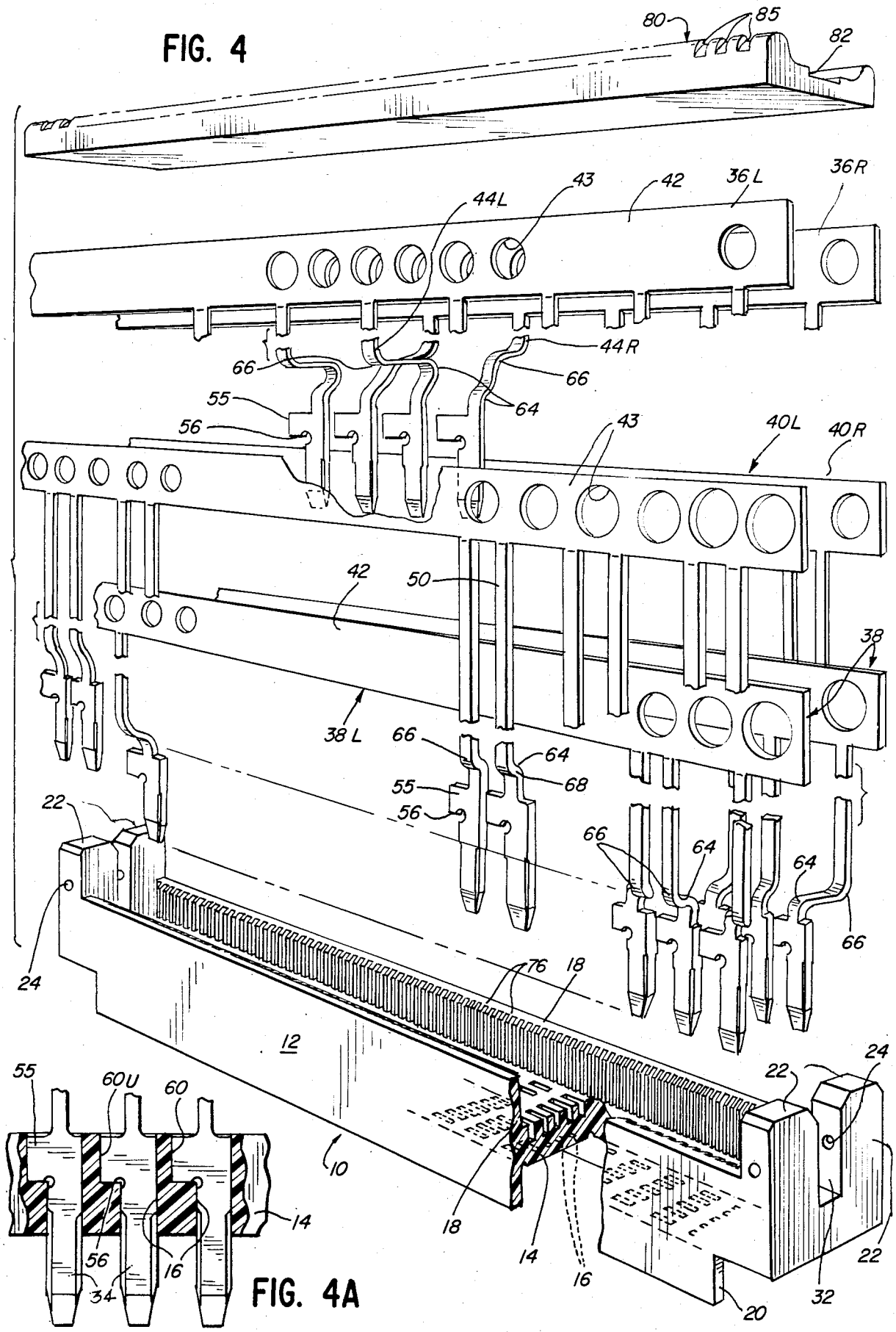
FIG. 4 is an exploded view illustrating the various components on an enlarged scale of a module connector made in accordance with this invention.
FIG. 4A is a fragmentary view, partly in elevation, illustrating contacts of the provided connector seated in insulator contact-receiving apertures and contiguous slots.

Referring now more particularly to FIG. 4, the various elements incorporated in a connector 10 made in accordance with this invention are illustrated. An assembly of transversely aligned connectors 10 is illustrated in FIG. 1 within a box A. The latter is representative of a housing employed in an aircraft or the like in which standard electronic modules are mounted on rails or the like for space conservation, and ease of repair and heat conductivity. Each connector 10 (FIG. 4) includes an insulator housing 12 which is of generally Hshaped configuration as is more apparent from the sectional view of FIG. 3 of the drawing. The insulator 12 includes a base portion 14 having a plurality of transversely and longitudinally aligned contact-receiving apertures 16. Integrally formed with base 14 are opposed upper sidewalls 18 and depending flanges 20. As above noted, the walls, flanges and base in cross section provide a generally H-shaped configuration which is resistant to bending. Such resistance to bending is of great importance, as connectors of the type herein disclosed are adapted to carry in excess of two hundred contacts. Accordingly, when mating of the contacts of such connector 10 is effected, a great load is imparted to the connector insulator 12 tending to flex or bend the same along the longitudinal axis. Such bending or flexing is to be avoided as such bending is conducive to lead breakage or contact rupture resulting in turn in circuit failure.

The connector insulator 12 is preferably formed of a filled thermoplastic material of great strength. A specific example of such material comprises that sold by Amoco under the trade name "Torlon" comprising a forty percent glass filled, polyamide-imide. Such composition possesses great strength in addition to desirable heat resistance, thermal expansion characteristic and necessary electrically insulating properties.

Referring once again to FIG. 4, it will be noted that end vertical ears 22 are formed integrally with the remainder of the insulator 12, and are transversely apertured at 24 for reception of pins such as pin 26 illustrated in FIG. 2. Pin 26 is adapted to secure a PC board mounting frame such as illustrated frame 28 of FIGS. 1 and 2, to the connector 10. Each frame 28 has secured to opposed faces of a center panel 29 thereof PC boards such as PC boards 30 illustrated in FIGS. 1, 2 and 3. The opposed longitudinal ends of the frames 28 are received in slots 32 disposed at the opposed ends of insulator 12 and defined by the insulator ears 22, see FIG. 4. Such frame ends are similarly apertured for penetration by securing pins 26 whereby the assembly of the frame-mounted PC boards and connector insulator are retained in a desired state of assembly.

In accordance with the construction of the provided connector 10, a large number of contacts are arranged in close packed relationship as indicated at the bottom portion of FIGS. 1 and 2 wherein the high density of contact blade portions 34 extending from the bottom of the connector insulators 12 is readily apparent.

To provide for such high contact density in the connector embodiment illustrated by way of example, the contacts are arranged in five longitudinal rows of openings 16 in the insulator base 14. Each longitudinal row comprises 50 openings whereby the connector 10 is adapted to carry 250 contacts. Obviously the number of contacts in the longitudinal and transverse rows may vary to meet the specific needs of the installation in which the provided connector is disposed.

The connector contacts may be formed from a continuous strip of contact-forming copper alloy material or other desirable conductive material of fabrication, moved along a path, and in the course of such movement, die members may stamp out the combs of FIG. 10. Upper comb 36 in FIG. 10 is adapted to be insertable in the openings 16 of the center longitudinal row of the five transverse rows of the connector 10. Each comb 38 comprises the contacts which will eventually be inserted in the second or fourth rows or intermediate rows of openings 16 of the connector 10. Comb 40 contains the contacts which will be inserted in the openings 16 in the two outermost or first and fifth rows of openings 16 of the connector 10 formed in the insulator base 14.

The combs 36, 38, and 40 may be either stamped from a continuous strip of material or otherwise suitably formed as by a chemical etching process. Each comb 36, 38 and 40 comprises an apertured, longitudinal carrier strip 42 from which extend, integrally formed contact portions 44 in comb 36, contact portions 45 in comb 38 and contact portions 50 in comb 40. Each contact portion 44, 45, and 50 comprises a solder-tail, a portion of which is to be eventually soldered to a PC board. The solder-tails terminate at a transverse connecting strip 52 from which depend the contact blade portions 34, as seen in FIG. 10.

The blanks or combs 36, 38 and 40 comprise the initial form of the connector contacts. The blanks are subjected to shearing and coining operations whereby the contact blade portions 34 have the ends thereof beveled as illustrated in FIG. 11, and the individual contacts are separated by intermittent shearing of the transverse connecting strip 52. The coining step forms the beveled edges B more clearly seen in the enlarged views of FIGS. 5 through 9. Edges B facilitate contact insertion in mating connectors such as tuning fork receptacles 35 illustrated in FIG. 3 of the drawing. It will be apparent from these figures, in addition to enlarged FIG. 11, that after shearing, each contact blade portion will be Integrally formed with a projecting stop 55 having stop surface 56. It is the function of the stop 55 to determine the depth to which each contact blade portion is received in an insulator opening 16.

It will be noted from FIG. 4A that each aperture 16 of each longitudinal row of contact-receiving apertures 16 illustrated in FIG. 4 has the upper portion thereof contiguously formed with an offset slot 60 formed on the upper surface of insulator base 14. The slots 60 have a depth equal to the width of the original blank strips 52 and portions 55. Accordingly, when the stop surface 56 of each contact stop 55 engages the bottom of slot 60 in which disposed, the contact will be fully inserted within its receiving insulator aperture 16. The various contacts are fully seated in the manner seen in FIG. 3 of the drawing with contact blade portions 34 projecting from the insulator undersurface.

Figure 5:
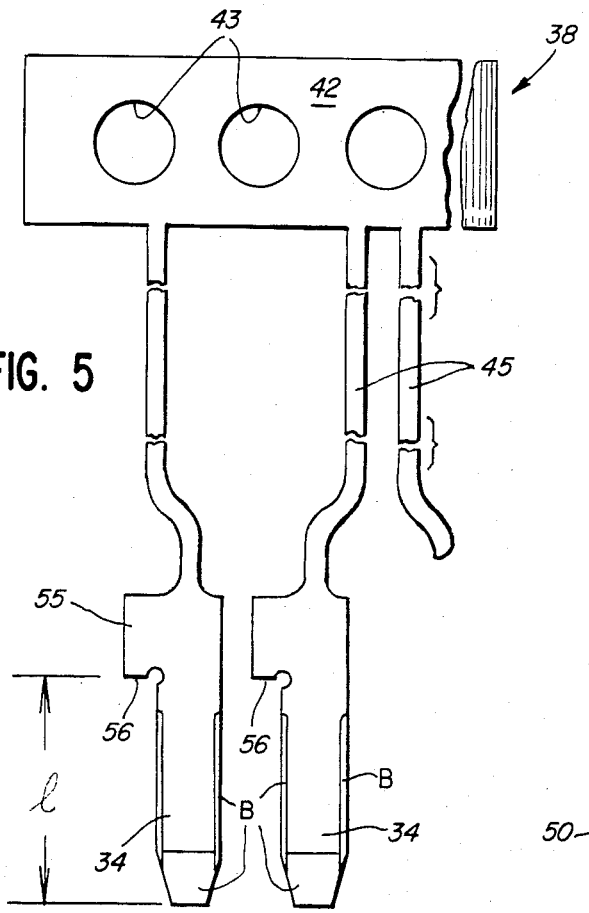
FIG. 5 is a fragmentary plan view of a blank from which contacts incorporated in a connector of this application are obtained.
Figure 6:
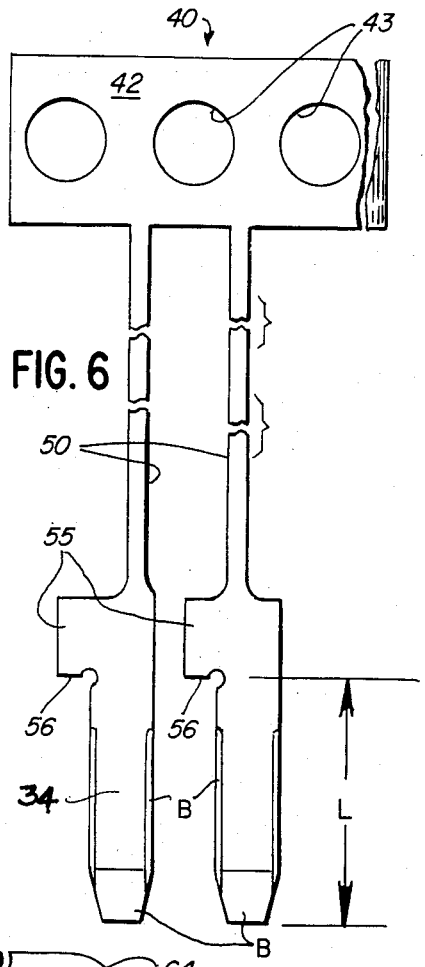
FIG. 6 is a view similar to FIG. 5 illustrating a second contact form incorporated in a connector of this application.
Figure 7:
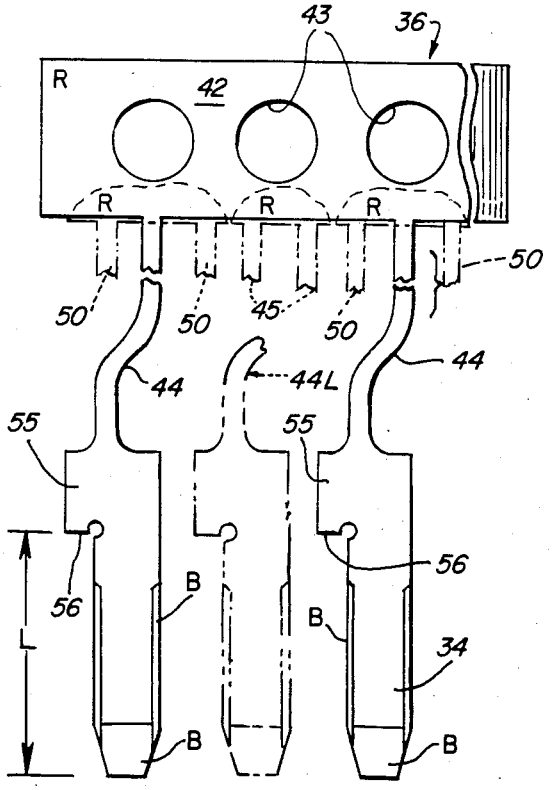
FIG. 7 is a view similar to FIGS. 5 and 6 incorporating a third form of contact employed in a connector made in accordance with this invention.
Figure 8:
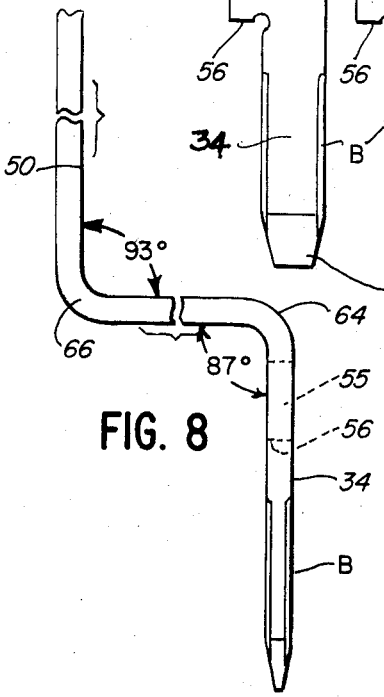
FIG. 8 is a fragmentary elevational view of a contact of the type illustrated in FIGS. 5, 6 and 7 having left-hand bend formed therein; prior to insertion in a connector made in accordance with this invention.
Figure 9:
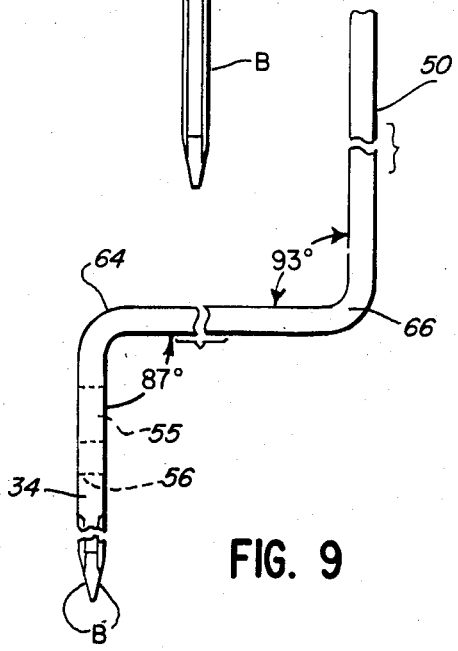
FIG. 9 is a figure similar to FIG. 8 illustrating a contact having a right-hand bend.

Following the shearing and coining operations above described, and prior to insertion of the contacts into the insulator 12, elongate solder-tail contact portions 44, 45 and 50 of the comb portions illustrated in FIGS. 7, 5 and 6 respectively are subjected to a bending operation illustrated in FIG. 8 or FIG. 9. It will be noted from these latter figures that a contact portion 50 of the comb 40 of FIG. 6 may be bent to the left in the manner illustrated in FIG. 8 adjacent its juncture to projecting stop 55 at 64, whereafter a continuation of such contact portion is again bent at substantially right angles at a second bend or elbow portion 66. Thus, the outside contact combs 40 may be sheared and coined into the condition illustrated in FIG. 6 whereafter the individual contact portions 50 may be bent as illustrated in FIG. 8 if comprising a left-side comb or into the configuration of FIG. 9 if comprising a right side comb.

The exploded view of FIG. 4 illustrates the bent contact portions 50 of left outside comb 40L, it being apparent from FIG. 4 that the portion of each contact portion 50 between the bends 64 and 66 i.e. contact portion 68, see FIGS. 3 and 13 is adapted to bring the vertical contact portion extending from bend 66 into an inner wall slot 70. Slots 70 are formed along the inner surfaces of the opposed walls 18 of the connector insulator 12. The slots 70 are most clearly seen in FIG. 4. The outer combs 40L and 40R illustrated in FIG. 4 are of the same construction with the exception that the upper arm portions of bends 64 are projected in opposite directions toward the adjacent sidewalls 18. Accordingly, the same blank 40 illustrated in FIG. 10 may be used for both outside rows of contacts merely by forming the bend 64 in different directions following the coining and shearing steps. Such combs will then have the appearance of the outside combs 40L and 40R in FIG. 13. The comb portions 38 of FIG. 5 following the coining and shearing steps also have contact portion 45 bent either to the right if forming the right intermediate row of contacts of comb 38R illustrated in FIG. 4, (i.e., second row from the right), or have the contact portions 45 bent to the left as in comb 38L of FIG. 4.

It is apparent that interfitting of each contact stop 55 in its respective slot 60 necessitates the formation of right and left hand combs. However if the slots 60 formed with each insulator opening 16 were longitudinally continuous, the two outside and intermediate combs 40 and 38 respectively could comprise the same comb which is mounted to point each contact bend 66 toward the adjacent sidewall 18.

It will be noted from FIG. 3 that the second and fourth row of contacts (or the two intermediate rows of contacts 38L, 38R of FIG. 4) have shorter blade portions than do the remaining contacts comprising the contacts of the two outside rows or the contacts of the center row. As a result the initial loading force is reduced upon insertion of the contact blade portions 34 into the receiving apertures of illustrated tuning fork connector receptacles 35. The force necessary for blade insertion may be gradually spread over the time interval between the initial engagement of the contacts of the center and the two outer rows of contacts with the receptacles 35 and the instant when all of the contacts are seated in their mating receptacles. As each blade 34 requires a loading force of about one-quarter pound for insertion in connector-receptacles of the type illustrated, the magnitude of the force exerted on the insulator 14 is apparent.

At the time of the mating of the shorter blade 34, the longer contact blades 34 will already be in sliding movement within their receiving receptacles, and accordingly, an exerted, lesser mating force is spread over a time interval and not concentrated in an initial blade-receptacle engagement. Such reduced force assists in assuring absence of insulator flexing or bending.

Referring once again to FIG. 4, it will be noted that in the center longitudinal row of insulator opening 16 two combs, 36R and 36L interfit in longitudinally offset relation. The successive contact solder-tails 44 of the two center combs 36 extend toward opposite insulator walls 18. Thus, vertical contact portions 44 R are adapted to be received in wall slots 70 of the right hand wall of the insulator illustrated in FIG. 4, and vertical contact portions 44L are adapted to be nestably received within slots 70 formed in the left insulator wall 18. When the combs of FIG. 4 are inserted in the housing 12 the combs will have an appearance similar to that of FIG. 13.

The interfitting or relative spacing of the vertical contact portions or solder-tails of the six combs employed for purposes of forming a completed connector is apparent from FIG. 7 of the drawing. In FIG. 7 the interweaving of the contact blades of the two center combs 36 is also apparent. The relative disposition of the solder-tails of the contacts of the intermediate combs 38 and the outer combs 40 is evident from the phantom line representations of the contacts from the latter combs as viewed from the left-side of the insulator.

It is apparent from FIG. 4 of the drawing that the contact portions between the bends 64 and 66 are longest in the two center combs 36 as the horizontal distance transversed by the contact solder-tails prior to reaching the sidewalls 18 is greatest with respect to the center row contacts. Obviously, the horizontal contact portions between the bends 64 and 66 in the combs 38 which are disposed between the center combs 36 and outer combs 40 have a length which is shorter than the corresponding contact length of the center combs but greater than the corresponding contact portions of the outer combs 40. This relative size relationship is apparent from FIG. 3 of the drawing.

Following the bending operations on each contact of each comb to either the left or right as indicated on FIGS. 8 or 9 of the drawing and prior to insertion into insulator 12, appropriate segments of the resulting contact comb portions are then plated to enhance their electrical conductivity and provide corrosion protection as by means of a nickel and overlying gold coating. Solder-tail portions are then coated with a tin-lead alloy as to facilitate subsequent soldering of the contact solder-tails to the PC boards. The six contact combs, i.e., two center combs 36 which are offset from each other in the manner illustrated in FIG. 7, the two intermediate combs 38 and the two outer combs 40 are then inserted in the insulator base 14. Contacts are inserted until the stop surfaces 56 of the contact portions 55 engage the bottoms of slots 60 in the manner of FIG. 4A. Each contact blade portion will then be extended its desired distance.

The contact comb-insulator asssembly will then be as appearing in FIG. 13. A hardenable resin 39 such as an epoxy resin is then added to the upper surface of insulator 12 between sidewalls 18. The contact portions between bends 64 and 66 and lying on the insulator upper surface are enveloped in such resin 39. While the resin is in an uncured state, mounting plate 80 most clearly seen in FIG. 4 is inserted between the right and left combs in the manner of FIG. 13. The plate 80 is precisely located relative to the opposed contact portions and insulator sidewalls as the resin cures with the plate in its final position illustrated in FIGS. 14–16, as well as FIG. 3.

Following curing of the resin the plate is integrally formed with the insulator, and cured resin 39. Plate 80 serves as a reinforcement resisting bending or flexing of the insulator 12 transversely to the longitudinal axis thereof.

Following curing of the resin the contacts are formed over the opposed edges of the plate 80 in the manner illustrated in FIGS. 14, 15 and 16. The contact formation positions inner contact solder-tail portions 86 in desired location relative to recess 82 in plate 80 in which a frame and supported PC boards are to be mounted.

The comb carrier strips and contiguous contact solder-tail portions of the various combs are then dipped in a hardenable rubber-like material M in the manner illustrated in FIG. 15 so as to rigidify the contact ends and prevent relative movement thereof. The resulting construction is then as appearing in FIG. 16 and ready for insertion of a mounting frame and printed circuit boards mounted thereon so as to form a final assembly of FIG. 3.

As seen in FIG. 16 the carrier strips may be broken free from the contact solder-tail portions with which they are integrally formed by bending at lines of weakness such as formed by notches 87 illustrated in Fig. 15. Removal of the metallic carrier strips allows testing of the electrical integrity of the contacts before assembly to the printed circuit boards by means of testing procedures well known in the art. After the mounting frame 28 and attached circuit boards 30 of FIG. 3 are inserted into engagement with the contact solder-tail portions 86 of the various combs, the portions 86 which have previously been tinned are soldered to pads on the circuit boards 30 at S in FIG. 3 as by vapor phase or infra red soldering techniques into a final rigid assembly.

In the course of forming the contact combs of FIG. 10 notches may be formed such as notches 90 illustrated in FIGS. 15 and 16. Notches 90 are formed adjacent the contact solder-tail portions 86 so that following the soldering operation, the remaining terminal contact portions extending from notches 90 may be readily snapped free leaving a final contact appearance as appearing in FIG. 3.

A heat activatable epoxy resin or other bonding agents such as resin 92 illustrated in FIG. 16 may be placed in the mounting plate recess 82 so that upon mounting the frame 28 and central panel 29 thereon a connector user need merely heat the resin 92 to activate the same and lock mounting frame 28 in place, As previously noted, in addition to such epoxy connection, the mounting frame such as frame 28 may also be secured to the connector housing by means of transverse pins 26 which traverses aligned openings 24 in ears 22 at opposed ends of the frame 28. Following bonding of the frame 28 within plate recess 82 a rigid monolithic structure results. Such structure is able to be employed in repeated mating connector engagements and disengagements without flexing and resulting damage to soldered connections.

Thus, it is seen that a novel connector construction has been provided which is particularly adapted for use in conjunction with a standard electronic module to be employed where space saving and rapidity of repair are desired or necessary as in aircraft computers. It is believed that the foregoing description has made apparent to those skilled in the art a number of modifications which may be made in the structure of the connector disclosed or in the method steps for carrying out the method of manufacture of such connector.

It will be appreciated that openings 43 appearing in the carrier strips 42 of the various contact combs above described may be employed not only in the progressive formation of the contacts while moving the combs through the various stamping, shearing and coining steps but may also be employed for purposes of engaging a fixture which is utilized in the course of seating the contacts in the connector insulator. As above noted, the various combs of FIG. 10 may be formed not only by means of a stamping operation but may also be chemically etched from sheets of the desired material of fabrication.

The high density contact arrangement and close-packed arrangement of the modules results in heat generation requiring removal as by means of a heat sink engaging the edges of the board-mounting frames 28. Such removal may be effected by circulation of liquid nitrogen or other cooling medium through a conduit resting on the frame edges.

As an alternative to the use of the bath M of FIG. 15, the terminal comb contact portions may be maintained in a state of spaced assembly by snap engagement with a plastic strip which interlocks with the apertured carrier strips or terminal portions of the contacts or both. Such strips have spacers which interfit between the contact solder-tails adjacent the carrier strips 42.

The material of fabrication of the insulator is designed in accordance with this invention so as to have a coefficient of expansion which is precisely the same as that of the printed circuit boards such as boards 30 in FIG. 3 of the drawing so as to prevent rupture of any soldered contacts as seen in FIG. 3.

The material of formation of plate 80 may be the same as that employed in forming insulator 12. Plate 80 may be relieved at 85 as in FIG. 4 along the opposed longitudinal edges for maintaining the contact portions formed thereover in spaced relation.

As has also been above noted, in view of the integral nature of the contacts, the contact lower blade portions 34 engaging the tuning fork connectors are integrally formed with the upper contact solder-tail portions of the various contact series. There is no intermediate connection as is present in prior art constructions wherein contact blade portions are interconnected by means of soldered connections to contact solder-tail portions engaging the PC boards. Also, in view of the more rigid nature of the provided construction above described, there is no necessity for reducing the thickness of the contact solder-tail portions engaging the PC boards so as to provide for a flexing action designed to prevent rupture of the solder connections as is done in prior art constructions.

The various plating layers applied to the contacts comprise an underlying nickel plate covering the entire contact portion. A gold layer covers that portion of each blade of the contact which engages a mating connector, and a lead-tin plate covers that portion of the contact solder-tail which engages the PC board and the adjacent contact portion defining the stop 55.

The provided contact is of sturdy construction and resistant to flexing whereby soldered contacts are maintained unbroken in the course of loading the contact blade portions of the connector into the mating tuning fork connectors or other receptacle connectors.

The rigidity of the contacts, soldered connections and insulator assembly provide an exceedingly high resistance to vibrational forces in the abovedescribed connector without experiencing contact or connection damage. As the illustrated connector is seen to have by way of example 250 contacts, and as a typical mating load is approximately one quarter pound per contact, it is seen that a load in the neighborhood of sixty two pounds is experienced in the course of loading a connector in place. The provided glass filled resin composition from which the insulator of the connector is made and which is reinforced by the mounting plate 80, and the epoxy resin 39 assists in eliminating any flexing which would tend to disturb any soldered connections between the PC boards and the contacts. As it is not necessary to reduce the cross section of the contact solder-tail portions of the provided connector, the contacts of this invention have a greater and more uniform current carrying capacity than the solder-tails of reduced section of the prior art.

This invention is to be limited only by the scope of the appended claims.

What is claimed is:

1. In a connector for mounting a circuit board thereon, the combination comprising an apertured insulator having opposed sidewalls; a plurality of contacts mounted in apertures of said insulator in a plurality of spaced longitudinal rows arranged at intervals across the width of said insulator; said contacts having first terminal portions projecting from a first surface of said insulator for engaging contacts of a mating connector; second contact portions contiguous with said contact first terminal portions and disposed above a second surface of said insulator opposed to said first surface; said second contact portions being in spaced-apart relation; rigid, electrically non-conductive means in which said second contact portions are disposed secured to the second surface of said insulator; third contact portions contiguous with said second contact portions arranged in parallel, non-contacting relation along at least one of said insulator side-walls; continuations of said third contact portions terminating in contact portions for engaging conductive paths on a circuit board; all portions of each contact being integrally formed; and reinforcing means for supportably mounting a circuit board and for preventing bending of said insulator transverse to its longitudinal axis fixedly mounted in said electrically non-conductive means; said contact second portions, electrically non-conductive means, reinforcing means and insulator defining a rigid assembly resistant to bending.

2. The connector of claim 1 in which said reinforcing means is adapted to support two circuit boards, and said third contact portions are aligned along said insulator opposed sidewalls.

3. The connector of claim 2 in which said reinforcing support means is adapted to engage a support frame for mounting opposed circuit boards thereon.

4. The connector of claim 1 in which a circuit board is mounted on said reinforcing means and said insulator is formed of a material of composition having thermal expansion characteristics closely matching those of the circuit board.

5. The connector of claim 1 in which said contact first terminal portions are in close-packed arrangement and extend from said insulator first surface at substantially right angles and are arranged in transversely and longitudinally aligned rows.

6. The connector of claim 1 in which said reinforcing means comprises a plate having a longitudinal recess, and a circuit board-supporting frame having opposed board-mounting surfaces is secured in said recess; said frame having circuit boards secured to the opposed board-mounting surfaces thereof; continuations of said contact third portions being secured to conductive paths on said boards; the thermal expansion characteristics of the material of composition of said insulator and said circuit boards being substantially the same.

7. The connector construction of claim 1 in which said reinforcing means has opposed longitudinal edges, and said continuations of the third contact portions arranged along the insulator sidewalls are bent over said opposed longitudinal edges whereby said edges assist in forming said continuations; said continuations comprising solder-tails.

8. The connector construction of claim 1 in which said opposed sidewalls are slotted for reception of the third contact portions arranged along said sidewalls and maintaining said third contact portions in spaced relation.

9. The connector construction of claim 1 in which each contact first terminal portion is integrally formed with a contact projecting stop portion, and each insulator contactreceiving aperture is contiguous with a slot for receiving a contact projecting stop portion; the slot stop portion engagement terminating passage of the contact first terminal portions into the insulator apertures.

10. The connector construction of claim 7 in which said reinforcing means is formed for reception of and mounting a circuit board thereon; at least some of the solder-tails being positioned for engagement with a circuit board when mounted on said reinforcing means.

11. In a method for forming a rigid connector for mounting a circuit board thereon and having a longitudinally reinforced, apertured insulator with opposed sidewalls; said insulator being traversed by electrical contacts having first contact portions aligned along at least one insulator sidewall, and second contact portions projecting from a first surface of said insulator for engaging contacts of a mating connector; said contacts also having intermediate portions contiguous and integrally formed with said first and second contact portions disposed on a second surface of said insulator body; the steps comprising mounting said contact second portions in longitudinal and transverse rows in said insulator body apertures arranged in a close packed arrangement; simultaneously arranging said contact intermediate portions on said insulator second surface and said contact first portions in spaced parallel relation along at least one of said insulator sidewalls; covering said contact intermediate portions with a hardenable resin; embedding a longitudinal reinforcing plate for reinforcing said insulator against bending in said hardenable resin prior to curing said resin.

12. The method of claim 11 in which said first contact portions are contiguous with contact continuations, and said method is in combination with the step of bending said continuations into overlying relation with opposed longitudinal edge portions of the reinforcing plate after said resin has cured.

13. The method of claim 11 in which said plate edge portions have openings for maintaining engaged contact portions in spaced relationship, and said bent continuations are located in said opening.

* * * * *